United States Patent [19]

Cauldwell et al.

[11] 3,940,584

[45] Feb. 24, 1976

[54] COAXIAL SWITCH FOR HIGH FREQUENCY SIGNALS

[75] Inventors: Jack D. Cauldwell; George P. Gallanis, both of Dayton, Ohio

[73] Assignee: Arvin Industries, Inc., Columbus, Ind.

[22] Filed: June 19, 1974

[21] Appl. No.: 480,689

[52] U.S. Cl. ..... 200/153 S; 333/97 S

[51] Int. Cl.[2] ..... H01P 1/10

[58] Field of Search ..... 200/153 S, 339, 304, 305, 200/149 R, 149 B; 333/7 R, 97 S

[56] References Cited

UNITED STATES PATENTS

| | | | |
|---|---|---|---|
| 2,603,733 | 7/1952 | Pastrick | 200/6 R |
| 2,697,767 | 12/1954 | Charles | 333/97 S X |
| 2,759,152 | 8/1956 | Charles | 333/97 S X |
| 2,769,068 | 10/1956 | Schuremann | 200/153 S |
| 2,816,198 | 12/1957 | Cherry | 200/153 S |
| 3,394,324 | 7/1960 | McClaflin et al. | 200/6 R X |

FOREIGN PATENTS OR APPLICATIONS

| | | | |
|---|---|---|---|
| 646,510 | 1/1949 | United Kingdom | 200/153 S |

*Primary Examiner*—Robert K. Schaefer
*Assistant Examiner*—William J. Smith
*Attorney, Agent, or Firm*—Biebel, French & Bugg

[57] ABSTRACT

Disclosed is an improved switch particularly adapted to be used as a coaxial cable switch for cable television systems because of its superior isolation of the signal inputs. The switch comprises an electrically insulating body, first, second and third terminals located on the body in spaced relationship, a movably mounted contact, which is movable along a predetermined path to form alternative conductive paths between the first terminal and either of the second or third terminals, and a partition means between said terminals and located adjacent the path of the contact to form a barrier to radiated signals from whichever of the second and third terminals that is not in contact with the movable contact. Additionally, terminating means for the unused terminal and/or shielding means to further isolate the unused terminal from the used terminal can be provided.

4 Claims, 4 Drawing Figures

COAXIAL SWITCH FOR HIGH FREQUENCY SIGNALS

BACKGROUND OF THE INVENTION

This invention is directed to an improved switch particularly adapted to be used as a coaxial cable switch for cable television systems because of its superior isolation of different inputs.

Switches capable of handling high frequency signals, i.e., up to 300 MHz, are frequently ineffective because of shielding problems. Either the switch itself is not sufficiently shielded from the surrounding environment or the inputs to the switch are not adequately shielded from one another. Such switches may be used, for example, in selecting inputs between cable and antenna, or between different cable inputs. In CATV systems these are known as A-B switches.

Presently available input switches have a rather low isolation between inputs, and are also of rather complicated construction. Therefore, it is desired to make a switch that is simple and economical in construction, and also provides high isolation between inputs.

Many high frequency input switches only deal with shielding the inputs from the environment, and not shielding one input from another input. This is generally done by a shielding chamber which encloses all of the terminals, including both input terminals and the output terminal, i.e., the housing merely serves as a high frequency shielded chamber. Usually, the chamber is designed so that it forms a waveguide below cutoff for the principal waveguide mode in the operating frequency range of the switch. This merely isolates the inputs in the switch. It does not isolate one input from another input.

U.S. Pat. No. 3,648,000 discloses a switch for selecting between high frequency cable TV inputs, and teaches a grounding means for providing increased isolation of the respective cables. It isolates by grounding the unused input contact and the contact member which makes the connection between the input and the output. No other isolation of the unused terminals is provided for or taught. This patent states that 75 decibels (db) of isolation are provided with such a construction.

SUMMARY OF THE INVENTION

The invention is broadly directed to an improved switch possessing improved isolation between the input terminals into the switch, whereby it may be used as a coaxial cable TV switch.

The switch of the invention can be provided an isolation of at least 90 decibels (db) at 300 Megahertz (MHz), and isolations as high as 97 db have been achieved. These values can be compared with a typical push or toggle switch which provides an isolation of about 20 db at 300 MHz, or the aforementioned patented switch which claims an isolation of 75 db.

The isolation of the terminals in the switches of the invention is primarily achieved by the use of simple partitions or barriers which isolate the unused input terminal from the cable input in use. Additionally, the unused input terminal may be terminated in a resistor to provide further isolation, and in the preferred embodiment, a grounding shield is located so as to provide an additional barrier to any radiated signals from the unused terminal.

The preferred structure is a rotary or toggle switch wherein a contact located on the peripheral surface of the rotor selectively makes the connection between first and second input spring contacts and an output spring contact located centrally between the inputs. The partitions are located between the respective inputs and the output, so that there is no straight line path for radiated energy between the unused input terminal and the connection in use. The partitions can be made of any conductive material, such as metal and the like, as long as they restrict the radiation of the high frequency emissions from the unused terminal. In the preferred embodiment, the partitions are made of the same material as the switch housing, i.e., cast aluminum or zinc. The partition can be made an integral part of the case or housing, and so can be molded along with the housing or casing. The result is a simple, inexpensive and highly effective shield for the coaxial input terminals.

The termination means for the unused terminal is basically a further contact located on the peripheral surface rotor which contacts the unused terminal and which is wired to a resistor, preferably a 75 ohm resistor. The other end of the resistor will be wired to a ground. In the preferred embodiment, a terminating means, i.e., a contact and resistor, are provided for each unused terminal and both terminating means are connected to the shielding means which provides six different contacts connected to ground.

The shielding means is basically a "U-shaped" contact of a conductive material wherein the arms of the "U" are spring contacts. The shielding means is located on the rotor such that it at least partially surrounds the rotor contact and further isolates the connection made by the rotor contact, between one of the input terminals and the output terminal, and the unused input terminal. The arms of the shield will contact the casing of the switch, grounding the shield, and providing the further isolation. In the preferred embodiment, the shielding means will have four other "arms" or contacts. Two of the arms will be located above and two below the plane of the "U" which will provide additional grounding contacts for both the shield and the terminating means.

It is therefore an object of this invention to provide an improved high frequency switch which is simple in construction and yet effectively shields the input terminals from one another; and to provide such an improved switch particularly adapted for use with cable television.

Other objects and advantages of the invention will be apparent from the following description, the accompanying drawings and the appended claims.

DESCRIPTION OF THE PREFERRED EMBODIMENT

Figure 1:
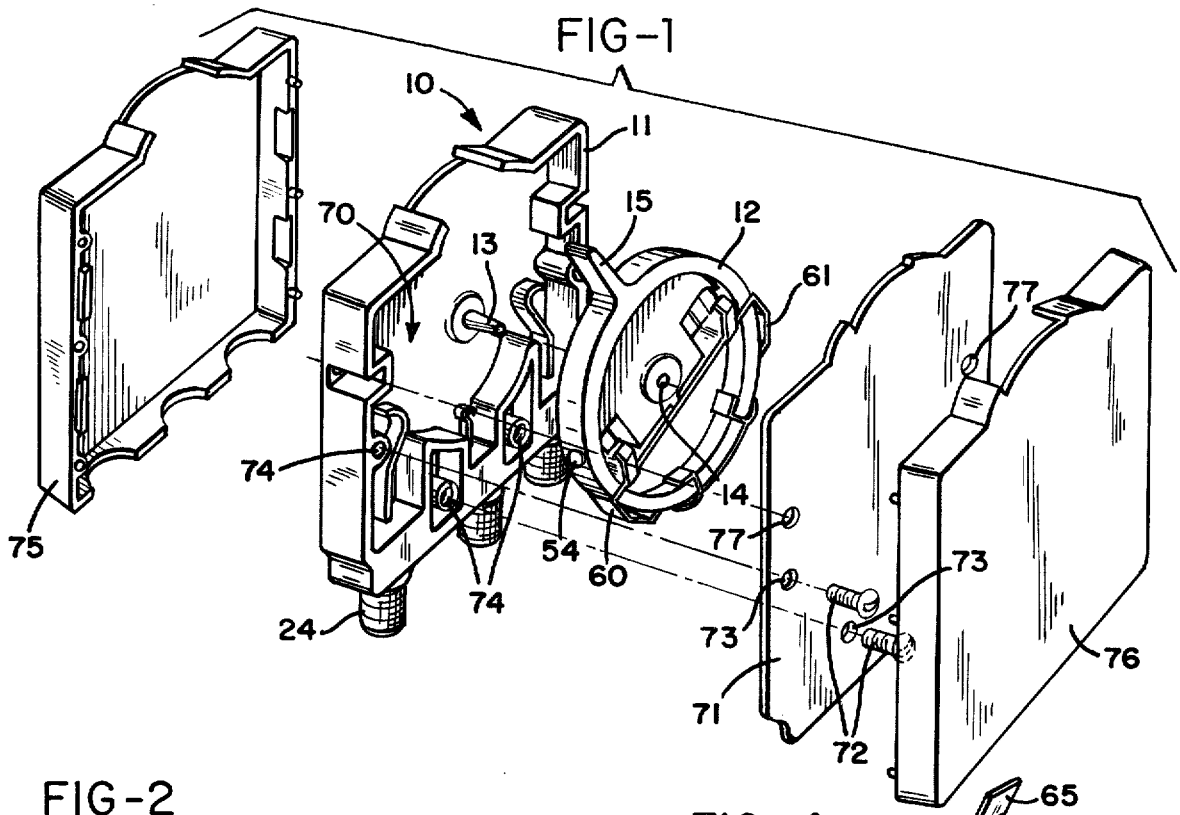
FIG. 1 is an exploded view of one embodiment of the switch of the invention particularly adapted for use with cable TV.
Figure 2:
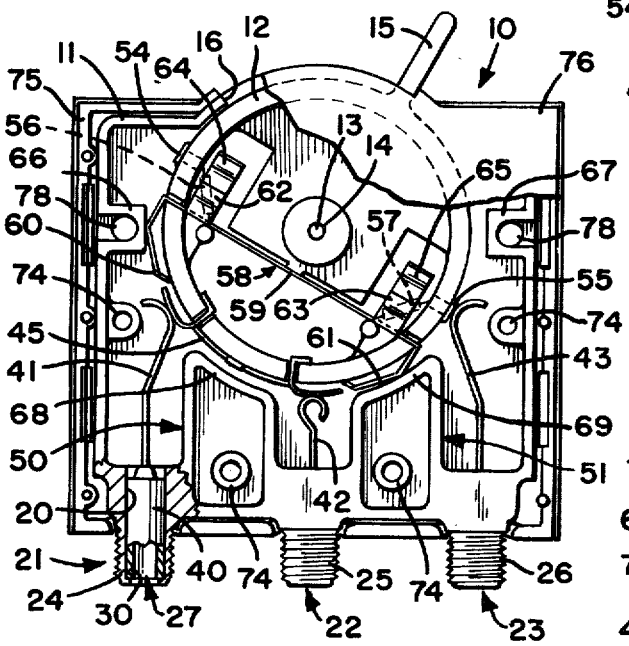
FIG. 2 is a side view, partially broken away, of the switch of FIG. 1.
Figure 3:
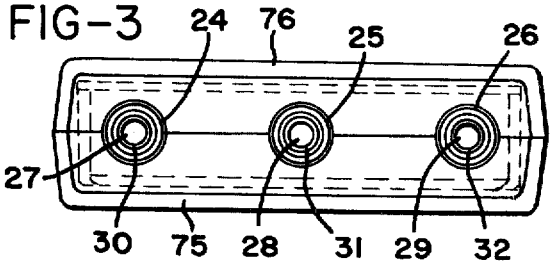
FIG. 3 is an end view of the switch of FIG. 2.

Referring to the drawings, which represent preferred embodiments, and in particular to FIGS. 1, 2 and 3, one embodiment of the invention is shown generally as switch 10. Switch 10 comprises a substantially rectangular casing or housing 11, which may be cast of metal such as aluminum, zinc and the like, having a rotor 12 mounted therein for rotation about pin 13 via hole 14. Rotor 12 is generally constructed from a synthetic plastic material, such as nylon, acrylonitrile-butadiene-styrene (ABS), and the like, but could be made from other materials including wood and the like.

As illustrated in FIGS. 1 and 2, pin 13 is an integral part of housing 11, with rotor 12 rotating freely about pin 13. Pin 13 will be made of the same material as the casing. Alternatively, pin 13 may be keyed to hole 14 in rotor 12, with pin 13 free to rotate about its axis in a hole (not shown) in housing 11, and may be made of a nonconductive material, such as plastic and the like, or a conductive material. Rotor 12 possesses handle 15 which extends through an appropriate edge opening 16 in housing 11, and which is grasped to rotate rotor 12.

Housing 11 is divided conveniently into a plurality of small compartments, such as compartment 20, to house the terminals of the switch. One end wall of housing 11 is extended outwardly to form integral coaxial ferrules 21, 22 and 23. Located centrally is output terminal 22, and located on either side of the output are the input terminals 21 and 23. Terminals 21–23 are conventional coaxial terminals wherein the outsides 24, 25 and 26 are electrically grounded to housing 11 and the insides 27, 28 and 29 are adapted to receive connectors (not shown), such as coaxial cable TV connectors and the like. The outsides 24–26 of ferrules 21–23 may be threaded, as shown in FIG. 2, so that a connector having an internally threaded jacket may be threaded on and secured to the coaxial ferrules. The ferrules need not be integral with housing 11, and so could be made separately and subsequently welded, threaded or the like to housing 11.

The insides 27–29 of ferrules 21–23, respectively, will normally be lined in some way with annular, cylindrical insulating material, such as linings 30, 31 and 32, which are comprised of plastic or the like so as to insulate the outer portions 24–26 from contact with the portion of a connector (not shown) inserted into the insides 27–29 of ferrules 21–23, which contact would short out the cable connector. The linings 30–32 can be separately formed and inserted, or, as shown in FIGS. 1–3, may be an integral part of the contact plugs.

Plugs, such as plug 40, are mounted within compartments, such as compartment 20, and are molded of a nonconductive material such as a synthetic plastic or the like. They are of a conventional construction, and are shown as cylindrically shaped. But, they could be other suitable shapes. The plugs hold spring contacts 41, 42 and 43 which are of a conventional construction. Spring contacts 41 and 43 are shown as comprised of resilient free ends which are in the shape of an open hook and extend interiorly of housing 11 and encapsulated ends which are within the plugs. The encapsulated ends are adapted to resiliently receive and make secure electrical contact with a cable inserted into the interiors 27 and 29 of the ferrules 21 and 23. Spring contact 42 is constructed similarly to contacts 41 and 43 except, as shown, the resilient free end is in the shape of an almost closed loop.

A metal contact 45, of copper, copper beryllium and the like, is mounted on the circumference of rotor 12. Contact 45 is for the purpose of contacting one of the inputs and the output to complete a conductive path from the input selected to the output. Thus, a TV signal from a coaxial cable inserted in, for example, input 21, travels from spring contact 41 across contact 45 to output 22 where it exits from the switch. A similar conductive path can be created between spring contact 43 of input 23 and the output 22.

Rotating rotor 12 via handle 15 selectively brings contact 45 into engagement with either of spring contacts 41 or 43. Spring contact 42 being centrally located is engaged when either of contacts 42 or 43 is energized. Rotor 12 will be rotatably held in the various switching positions by the pressure of the spring contacts alone. But, it may be desirable to include some additional means (not shown) to hold the rotor in the various switching positions. Such a means could also provide the toggle action of the switch. One such means would be to provide a pin on the rotor which would act against a leaf type spring held by some stationary part of the switch, e.g., the bottom face of the switch. Another toggle means might be to use a ball and detent means, i.e., a spring biased ball located in the casing which acts against an indent or series of indents in the peripheral surface of the rotor. Such constructions are conventional in the art.

Even though an input is separated from and not electrically connected to the output when it is not in use, it may interfere with the output because of signals radiated from the exposed spring contact. In order to prevent the unused input from interfering with the input in use, barriers 50 and 51 are provided which isolate and shield the unused input. Barriers 50 and 51 are shown as trapezoidially shaped chambers which are integral with and of the same material as casing 11. But, they could be made separate and attached by some appropriate means, and could comprise other shapes such as rectangular wall-like pieces and the like. There is no criticality in the length, shape or spatial location of the barriers, as long as they serve to prevent straight line radiation between the unused terminal and spring contact and the connection in use. It may be desirable to provide a further shielding and/or terminating means for use with and in addition to barriers 50 and 51. In this regard, any conventional terminating system employing a resistance means can be used in conjunction with the barrier system of the invention. The shielding means is set forth in greater detail hereinafter.

Contacts 41 and 43 will normally be spring biased toward contact 45 to insure firm physical and electrical contact when they are in use by being engaged by contact 45. When they are not in use, contacts 41 and 43 will be engaged by a terminating means. The terminating means comprises terminating contacts 54 and 55, which are also located on the peripheral surface of rotor 12, and resistors 56 and 57 which are connected to a ground and can comprise, e.g., 75 ohm resistors. Contacts 54 and 55 are spaced further around the rotor from contact 45, such that when, as shown for example in FIG. 2, input contact 41 is engaged by rotor contact 45, unused input contact 43 is engaged by terminating contact 55. Similarly, when contact 43 is in contact with contact 45, contact 41 is engaged by terminating contact 54. Contacts 54 and 55 comprise conductive rivets or eyelets, as shown in FIG. 2, which pass through the peripheral surface of rotor 12. Other structures or configurations can be used as long as they provide an electrical contact with the respective unused input. Resistors 56 and 57 may be conveniently wired to shielding means 58 for grounding purposes, and are connected to the eyelets 54 and 55 and shielding means 58 by soldering or other appropriate fastening means.

Figure 4:
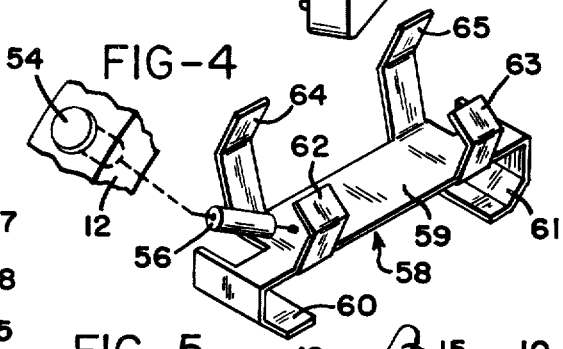
FIG. 4 is a perspective view of the shielding means used to isolate and terminate the unused input terminal in accordance with the teachings of the invention.

Shielding means 58, as shown in FIG. 4, is broadly a unitary, generally U-shaped, generally full width (as compared to the width of rotor 12) conductive strip which is principally comprised of a body portion 59 and arms 60 and 61 which are spring contacts. Shield 58 is located on rotor 12 such that it partially surrounds rotor contact 45, with arms 60 and 61 being located on either side of contact 45 and on the circumference surface of rotor 12. Contact arms 60 and 61 make grounding contact with the sides of casing 11, as at bosses 66 and 67, or with facing sides 68 and 69 of barrier chambers 60 and 51, respectively. Although the principal shield portions, including body portion 59 and arms 60 and 61, are shown as a bent, generally rectangular, flat sheet having further arms or contacts 62–65 extending therefrom, its shape is not critical. What is important is that grounded shield 58 provides an additional barrier to the transmission of interfering signals from the unused terminal and spring contact. Because the shield is located on the rotor, it provides a "moving" shield which is always located around the active terminals. Further, the combination of barriers 50 and 51 and shield 58 provides a barrier which essentially totally surrounds and isolates the active terminals, such as in FIG. 2, input 21 and output 22, from the unused terminal, e.g., terminal 23.

Additionally, four spring contacts or wiper fingers 62–65 may be located on shield 58 to provide additional grounding contacts, with two of the fingers 62 and 63 being above the plane of the U-shaped, while the other two contacts 64 and 65 are located below the plane of the U-shape.

The other fingers 62-65 also provide either direct or indirect grounding contacts. Fingers 64 and 65 will be in contact with the bottom 70 of casing 11, while fingers 62 and 63 will contact metal shield 71 which covers the switch and acts as an electrostatic shield. Shield 71 is made of copper and the like and provides ground contact for fingers 62 and 63 since it is attached to casing 11 by screws 72 in appropriate holes 73 in shield 71 and screw holes 74 in casing 11. The locations and number of screws are not critical and so could be varied. Further, other attaching means could be employed.

The housing may be removably mounted in synthetic plastic housing of a material such as ABS, nylon or the like, such as outer covers 75 and 76. Covers 75 and 76 are preferably somewhat resilient, and protect the switch from possible physical damage, as well as providing shock hazard protection. The plastic covers are not necessary, though, and the switch can be used without them. Further, holes 77 and 78 in shield 71 and casing 11, respectively, are provided so that the switch can be attached by screws or the like (not shown) to a television or other support, or combined with other switches.

Figure 5:
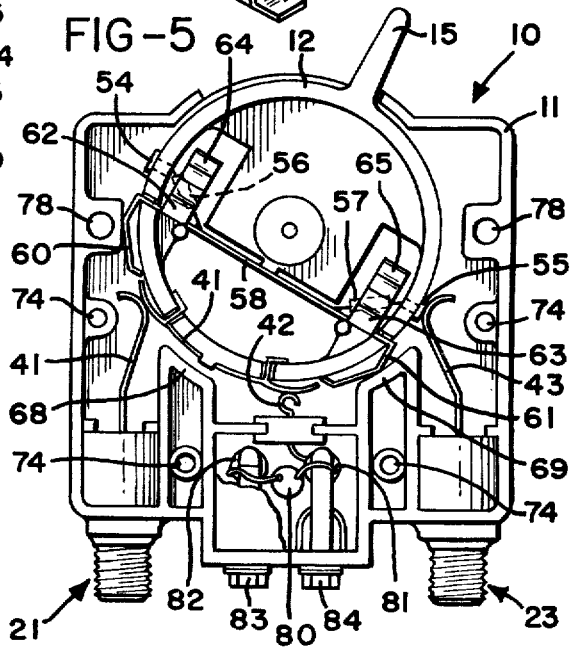
FIG. 5 is a side view of another embodiment of the switch, similar to FIG. 2.

In the embodiment shown in FIG. 5, the switch is adapted to be used as a 300 ohm switch, as compared to FIGS. 1–3 where the output would be an unbalanced 75 ohms, so a conventional impedance matching circuit is provided to transform the unbalanced 75 ohm input of the coaxial TV cable to a 300 ohm balance output. A transformer is used as an impedance matching device and converts an unbalanced system to a balanced system. The structure and operation of the switch are identical with that of the embodiment of FIGS. 1–3 and so the same reference numerals are accordingly used for identical parts.

Spring contact 42 receives the signal from contact 45 on rotor 12. Contact 42 is connected to one of the loads of the primary side of a transformer 80 through a first DC blocking capacitor 81. The opposite primary lead of the transformer is connected to one lead of a second DC balancing capacitor 82, the opposite end of which is grounded to the housing. The secondary of the transformer 80 is connected to a pair of screws 83 and 84, which are adapted to be connected to the antenna input of the television set. The center lead of the transformer secondary is electrically grounded by means not shown in the drawings.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. A switch for use in wide band systems handling high frequency signals, comprising:

a hollow body having at least an inner surface which is electrically conductive, first, second and third terminals on said body located in spaced relation, each of said terminals having contact portions connected to said conductive surface of said body and also having contacts projecting into said body, a rotor of electrically non-conductive material, a movable contact carried on the circumference of said rotor and of a length to connect the contact of said first terminal alternatively with the contacts of either said second or third terminal, means rotatably supporting said rotor in said body for arcuate movement of said movable contact to alternative positions connecting the first terminal to either the second or third terminal, means connected to said rotor and extending externally of said body for moving said rotor, electrically conductive partition means incorporated in said body and extending inwardly to adjacent the circumference of said rotor to form barriers to radiation from the exposed terminal contacts to each other.

2. A switch as defined in claim 1, including an electrically conductive shielding means on said rotor surrounding said movable contact and constructed and arranged to contact said conductive surface of said body.

3. A switch as defined in claim 1 including terminating contacts on said rotor arranged to engage whichever of the second and third terminal contacts is not contacting said movable contact, and terminating impedance means connected between said terminating contacts and the conductive surface of said body.

4. A switch for use in wide band systems handling high frequency signals, comprising:

a hollow body which is electrically conductive, first, second and third coaxial terminals on said body located in spaced relation, each of said terminals having outer contact portions connected to said body and also having inner contacts projecting into said body, the inner contacts of said second and third terminals being on opposite sides of and equally spaced from the inner contact of said first terminal, a rotor of electrically non-conductive material, a movable contact of arcuate shape carried on the circumference of said rotor and of a length to connect the inner contact of said first terminal alternatively with the inner contacts of either said second or third terminal, means rotatably supporting said rotor in said body for arcuate movement of said movable contact to alternative positions connecting the inner contacts of either the second or third terminal to the inner contact of the first terminal, means connected to said rotor and extending externally of said body for moving said rotor between said positions, and partition means integral with said body and extending inwardly from between said terminals to adjacent the circumference of said rotor to form barriers to radiation between the exposed and unconnected inner contacts.

* * * * *